United States Patent [19]

Marsh

[11] Patent Number: 4,655,389

[45] Date of Patent: Apr. 7, 1987

[54] COLLAPSIBLE CONTAINERS AND METHODS OF MANUFACTURING THE CONTAINERS

[75] Inventor: Sydney A. Marsh, Brighton, England

[73] Assignee: Marshall Cavendish Services Limited, London, England

[21] Appl. No.: 635,443

[22] Filed: Jul. 30, 1984

[30] Foreign Application Priority Data

Aug. 4, 1983 [GB] United Kingdom ..... 8321027
Sep. 29, 1983 [GB] United Kingdom ..... 8326134

[51] Int. Cl.[4] ..... B65D 5/62; B65D 90/06

[52] U.S. Cl. ..... 229/48 T; 220/418; 220/461; 229/122; 229/126; 229/DIG. 4; 493/133; 493/380; 493/386; 493/908

[58] Field of Search ..... 229/37 R, 48 T, DIG. 4, 229/6 R, 3.1, 23 C, 3.5 R, 33; 220/416–418, 460, 461, 462, 463, 75, 83, 902; 493/93, 114, 133, 380, 381, 386, 908, 907, 906; 428/35, 54, 55, 68, 70, 71, 74, 76

[56] References Cited

U.S. PATENT DOCUMENTS

| | | | |
|---|---|---|---|
| 1,173,645 | 2/1916 | Blount | 229/DIG. 4 |
| 1,565,765 | 12/1925 | Walter | 229/DIG. 4 |
| 1,698,699 | 1/1929 | Andrews | 229/37 R |
| 1,708,700 | 4/1929 | Maier | 229/DIG. 4 |
| 1,729,126 | 9/1929 | Reimer | 206/425 |
| 2,291,542 | 7/1942 | Filler | 229/DIG. 4 |
| 2,320,166 | 5/1943 | Arnold | 229/6 R |
| 2,634,046 | 4/1953 | Weber | 229/DIG. 4 |
| 2,693,894 | 11/1954 | Elmendorf | 229/23 C |
| 2,719,808 | 10/1955 | Elmendorf | 229/23 C |
| 2,770,406 | 11/1956 | Lane | 220/418 |
| 3,024,935 | 3/1962 | Vinick | 229/3.5 R |
| 3,251,382 | 5/1966 | Tatsch | 220/902 |
| 3,337,114 | 8/1967 | Lockwood | 229/3.5 R |
| 3,902,651 | 9/1975 | Marshall | 229/3.5 R |
| 4,011,983 | 3/1977 | Greene | 220/441 |
| 4,267,957 | 5/1981 | Holmström | 229/17 G |
| 4,269,347 | 5/1981 | Cavan, Jr. | 229/37 E |
| 4,511,078 | 4/1985 | Rausér et al. | 229/48 T |

FOREIGN PATENT DOCUMENTS

| | | | |
|---|---|---|---|
| 1140354 | 7/1957 | France | 229/33 |
| 1576115 | 6/1969 | France | 229/37 R |

*Primary Examiner*—William Price
*Assistant Examiner*—Gary E. Elkins
*Attorney, Agent, or Firm*—Lon H. Romanski

[57] ABSTRACT

This invention relates to containers and methods of, and apparatus for, manufacturing containers. A container in accordance with the invention includes four walls (202–205, FIG. 1, or 301–303 and 305, FIG. 4), and a base (201, FIG. 1, or 306, FIG. 4). The base is constituted by two flaps (206 and 207 or 307 and 308) arranged so that they can be moved between a first position in which the container can be folded flat, and a second position in which they hold the four walls in a generally rectangular formation.

The container may be manufactured by sealing six boards (4, 5 and 6) between two webs of PVC material drawn from supply rolls (50 and 51). The sealing is carried out by means of a welding process which also forms the boards (4 and 5) into hinged pairs. In further welding processes, boards (6) are hingedly connected to the boards (4 and 5). Finally, two pairs of boards (4 and 5) are hingedly connected together to form the four walls of the container. In the welding process, a raised portion (123, FIG. 22) is formed to hold one of the two flaps (6) in its second position.

23 Claims, 22 Drawing Figures

H
98
130
130
131
78
D
92
94
93
131
130
79
80
81
82
83
G
C
130
79
85
A
E
79
86
79
91
84
89
90
87
5
4
B
6
6
4
F
5
88

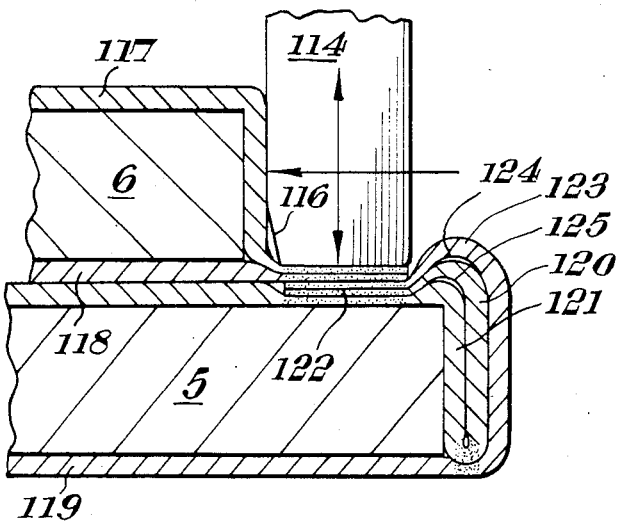
Fig. 21
Fig. 22
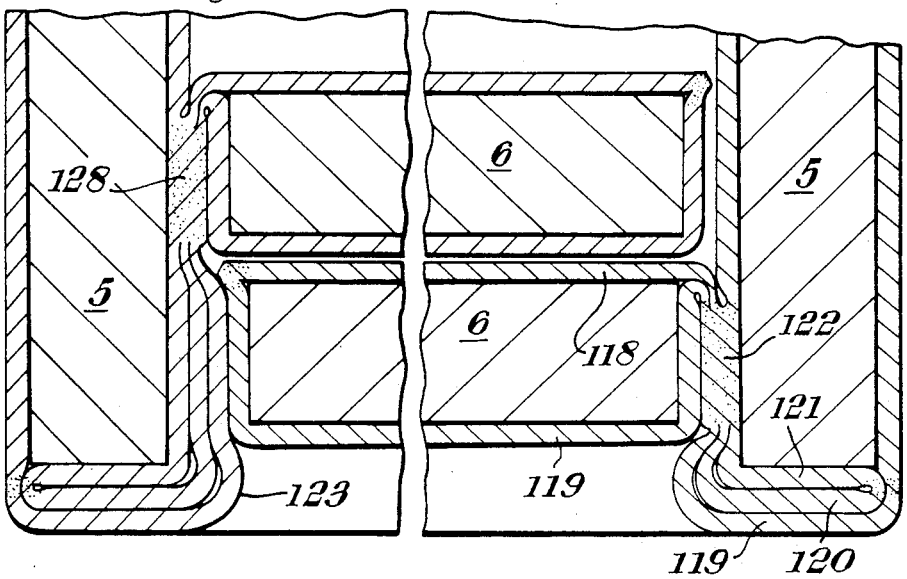

COLLAPSIBLE CONTAINERS AND METHODS OF MANUFACTURING THE CONTAINERS

This invention relates to containers and to methods of, and apparatus for, manufacturing containers. The invention is particularly concerned with containers which, in their normal condition of use, are in the form of a hexahedron. In containers of the kind with which the invention is concerned, a first face of the hexahedron will normally be rectangular, and four further faces will be perpendicular to said first face, adjacent ones of said further faces also being perpendicular to each other. The sixth face of the hexahedron, which will be opposite said first face, may be open or may be in the form of, or provided with, an openable lid. Further, said sixth face may be parallel to said first face, or may be inclined with respect thereto.

In some embodiments of the invention, the first face of the hexahedron will form the base of the container, and said four further faces will form four walls, while the sixth face constitutes the top of the container. However, in other embodiments of the invention, the first face of the hexahedron will constitute an upright wall of the container which may, for example, constitute the front of the container. In such embodiments, the base of the container will be constituted by one of the four further faces. In these embodiments, the sixth face of the container will also be upright and again may be open or may be provided with an openable or a removeable cover. For the sake of convenience in describing some of these embodiments, reference will be made to the front and the rear of the container. However in this case the terms "front" and "rear" are used only to distinguish two of the faces for the sake of clarity. Accordingly it may be that, when the container is in use, the face referred to as the rear panel may constitute the front of the container, and vice versa. Similarly the term "side" may be used to distinguish one or more of the faces, and it could be that, when the container is in use, one of the faces referred to as a side would normally be regarded as the front of the container. It is even possible that, when the container is in use, the face referred to as the base of the container would be regarded as the front of the container. Accordingly these definitions are not to be regarded as having any limiting effect other than to distinguish the various faces from each other.

Containers of the kind with which the invention is concerned are used particularly for the storage of record cards, gramophone records and computer discs.

It is one object of the invention to provide a container which, in its normal condition of use, is relatively rigid but which can easily be folded flat for storage and transport.

It is another object of the invention to provide a method of, and apparatus for, manufacturing containers of the kind referred to in the preceding paragraph.

From one aspect the invention consists in a container including four walls and a base, wherein said base is constituted by two flaps, each hingedly connected to a respective one of said walls, and wherein each of said walls is hingedly connected to two adjacent walls, the arrangement being such that said flaps can be moved between a first position in which each is substantially coplanar with, or parallel to, the wall to which it is hingedly connected, and a second position in which each is substantially perpendicular to the wall to which it is hingedly connected, the walls of said container being capable of being folded substantially flat when the flaps are in their first positions and being held in a generally rectangular formation by the flaps when they are in their second positions.

Preferably each of the walls and each of the flaps is constituted by a board covered on both sides with flexible weldable material. The term "board" is used herein to include not only cardboard but also any substantially rigid synthetic resin material having properties similar to those of cardborad. The flexible weldable material is preferably a synthetic resin material, in particular flexible polyvinyl chloride sheeting.

When the walls and flaps consist of boards covered with flexible weldable material, the hinge connections are preferably constituted by the flexible weldable material.

From another aspect the invention consists in a container including four walls and a base, wherein each of said walls in constituted by a board covered in flexible weldable material which also forms hinge connections between said walls, and wherein said base is constituted by two flaps, each consisting of a board covered in flexible weldable material which, in each case, also forms a hinge connection between the respective flap and one of said walls.

In one particular embodiment of the invention the height of the front wall of the container is less than the height of the rear wall, and the upper edges of the two side walls are inclined to join the top of the rear wall to the top of the front wall. Preferably one of the flaps is hingedly connected to the front wall of the container and the other flap is hingedly connected to the rear wall. Preferable each of the flaps extends over substantially the whole of the base of the container so that, when the flaps are in their second positions, the flap connected to the front wall is in engagement with the rear wall and the flap connected to the rear wall is in engagement with the front wall. Preferably a channel is provided in the inner face of the front or rear wall to receive the edge of the flap connected to the opposite wall.

It is to be understood that, when the flaps are in their second positions, one of the flaps will rest on top of the other flap. It will hereinafter be assumed that the flap connected to the rear wall is on top of the flap connected to the front wall. In this case the channel referred to above will be in the rear wall.

With the particular arrangement being assumed, the front edge of the flap which is hingedly connected to the rear wall of the container rests on the hinge connection between the other flap and the front wall. Accordingly the contents of the container are supported by the flap which is hingedly connected to the rear wall and the weight of the contents does not tend to move the flaps from their second positions. The rear edge of the flap which is connected to the front wall thus does not carry any of the weight of the contents and this flap can therefore readily be retained in its second position by engagement between its rear edge and the channel provided in the rear wall.

When the two flaps are moved to their first positions, both flaps are moved inwardly with respect to the container. Under these conditions the inner surface of the flap which is hingedly connected to the rear wall is in contact with the inner surface of the rear wall, and the inner surface of the flap which is hingedly connected to the front wall is in contact with the inner surface of the front wall. In the particular embodiment previously referred to, in which the height of the front wall is less than the height of the rear wall, the dimensions of the base of the container are preferably substantially identical to the dimensions of the front wall. Thus, in this particular arrangement, when the flap connected to the front wall is in its first position, the edge of the flap remote from its hinge connection is level with the upper edge of the front wall.

Preferably the hinge connections between the four walls are arranged to enable the thickness of one of the flaps to be accommodated within the hinge when the walls are folded flat. Since it is only necessary for the container to fold in one direction, it is possible to design the hinges so that only two diagonally opposite hinges are capable of receiving the thickness of a flap. In this connection it should be noted that, in the folded condition, one of the side walls has its inner surface facing the inner surface of the rear wall and its inner and outer surfaces substantially coplanar with the respective surfaces of the front wall, while the other side wall has its inner surface facing the inner surface of the front wall and its inner and outer surfaces substantially coplanar with the respective surfaces of the rear wall.

From yet another aspect the invention consists in a method of manufacturing a container comprising the steps of:

(a) covering six boards with flexible weldable material to form respectively front and rear panels, first and second side panels and first and second flaps, said first side panel having a first hinge connection formed by said flexible weldable material with said front panel and said second side panel having a second hinge connection formed by said flexible weldable material with said rear panel;

(b) forming a third hinge connection from said flexible weldable material between the free edge of said first side panel parallel to said first hinge connection and the free edge of the rear panel parallel to the second hinge connection, forming a fourth hinge connection from said flexible weldable material between said first flap and said front panel and a fifth hinge connection from said flexible weldable material between said second flap and said rear panel so that said flaps are substantially in line and perpendicular to said side panels; and (c) forming a sixth hinge connection from said flexible weldable material between the free edge of said second side panel and the parallel free edge of said front panel;

the arrangement being such that said flaps can be folded into positions in which they are perpendicular to the front and rear panels and thus hold the side panels perpendicular to the front and rear panels.

It is to be understood that a container manufactured by the method defined in the preceding paragraph is capable of being folded flat for storage or transport but can also be erected into a relatively rigid structure. The front and rear panels of the container are preferably rectangular and the sides of the container may either be rectangular or trapezoidal. If the side panels are rectangular, the dimensions of the front and rear panels will be identical, and in any case the length dimension of the two flaps will be substantially equal to the spacing between the two side panels when the container is erected, and the width dimension of the flaps will be substantially equal to the spacing between the front and rear panels when the container is erected.

It is to be understood that, when the container is erected, one of the flaps will be on the outside of the container whereas the other flap will be in the interior of the container. It will be assumed for the purposes of the following description that the first flap is on the outside and the second flap is on the inside, but it is to be understood that this arrangement can be reversed.

The method of manufacturing in accordance with the invention preferably includes two additional steps which consist of welding part of the flexible weldable material constituting the fourth hinge connection to the interior of the front panel, and welding part of the flexible weldable material constituting the fifth hinge connection to the interior of the rear panel. When the first flap is on the outside, the weld of the material constituting the fourth hinge connection will be relatively close to the outer edge of the front panel, while the weld between the material of the fifth hinge connection to the rear panel will be displaced inwardly from the outer edge of the rear panel by the thickness of the first flap.

Preferably the welding of the material constituting the fifth hinge connection to the rear panel also produces a channel between the outer edge of the rear panel and the weld, which channel serves to receive the free edge of the first flap and hold that flap in position.

Two embodiments of the invention and one form of apparatus for manufacturing a container in accordance with the invention will now be described with reference to the accompanying diagrammatic drawings, in which.

Figure 18:
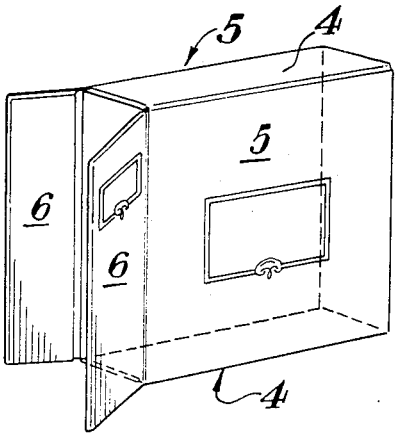
FIG. 18 is a perspective view of the container after the weld has been made, as indicated in FIG. 17.
Figure 19:
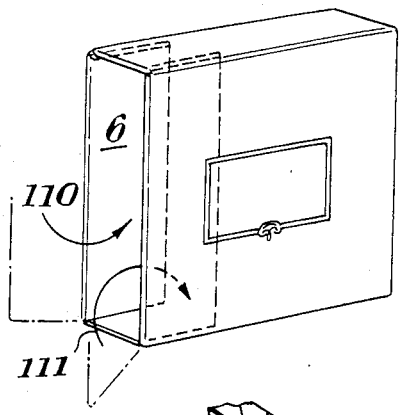
Figure 20:
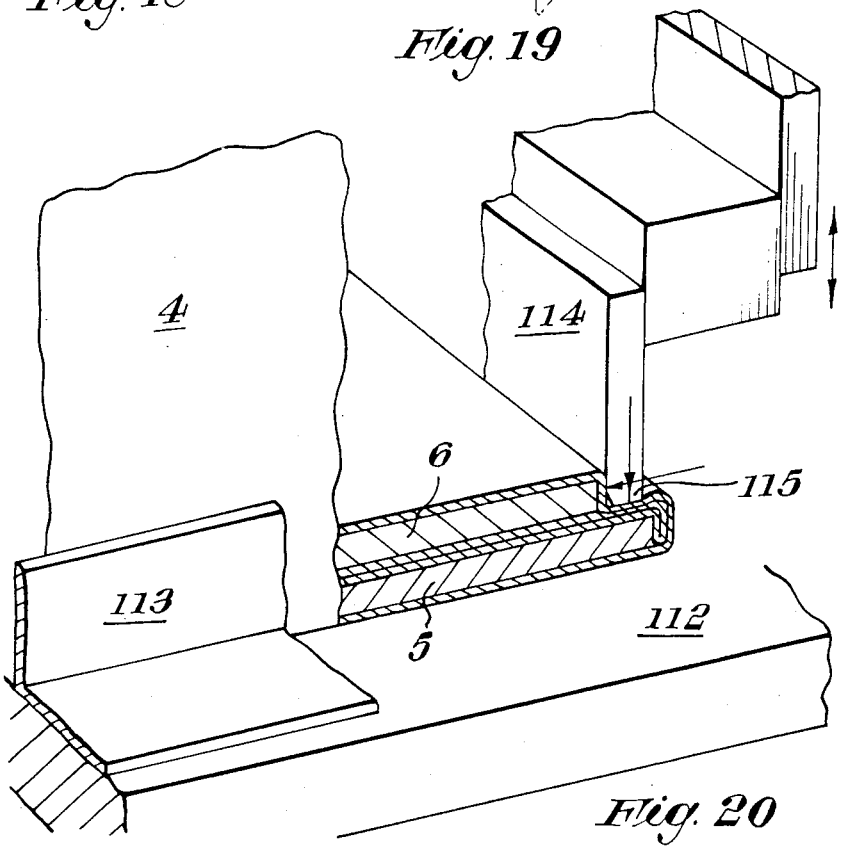

FIG. 19 indicates the manner in which the flaps are folded inwardly into the container illustrated in FIG. 18; and FIGS. 20, 21 and 22 are enlarged views illustrating further welds carried out on the container.

Figure 1:
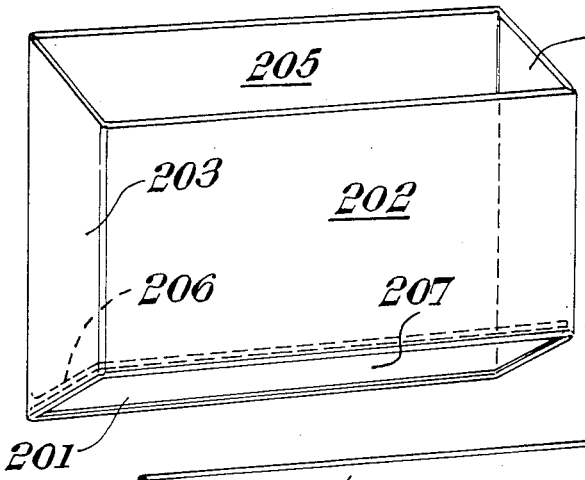
FIG. 1 is a perspective view of a container in accordance with the invention, looking at the container from below in order to show the base thereof.
Figure 2:
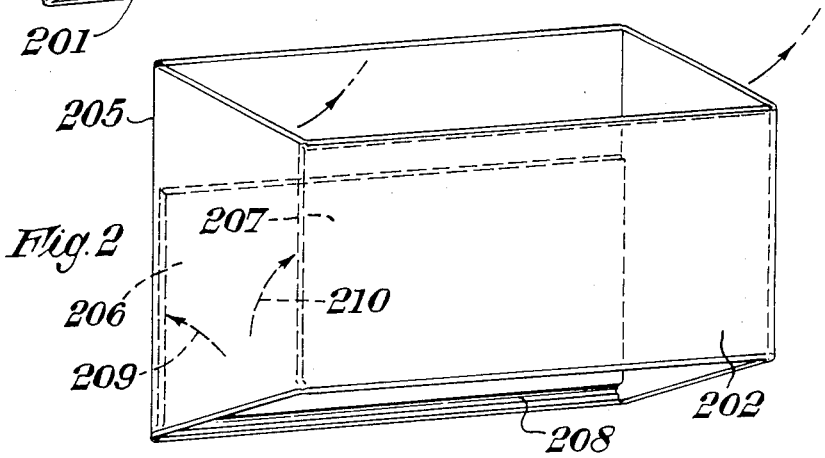
FIG. 2 is a view of the container similar to that of FIG. 1, but indicating the manner in which the flaps are moved from the normal condition of use.
Figure 3:
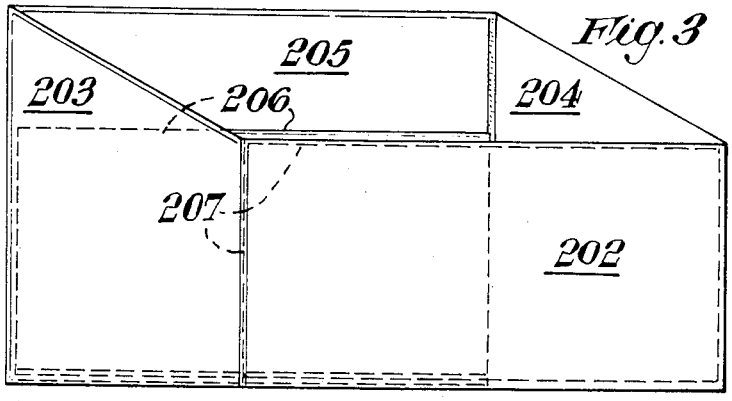
FIG. 3 is a plan view showing the container of FIGS. 1 and 2 in the folded condition.

Referring now to FIG. 1-3 of the drawings, it will be seen that the container illustrated includes a base 201, a front wall 202, two side walls 203 and 204, and a rear wall 205. The height of the front wall 202 is less than the height of the rear wall 205, and accordingly the upper edges of the two side walls 203 and 204 are inclined to join the top of the rear wall to the top of the front wall. The top of the container is open and the base of the container is constituted by two flaps 206 and 207. When the container is in the normal condition of use, as illustrated in FIG. 1, the two flaps 206 and 207 are in contact with one another, with the flap 206 resting on the flap 207. The flap 206 is hingedly connected to the rear wall 205, and the flap 207 is hingedly connected to the front wall 202. In the said normal condition of use, the free edge of the flap 207 engages in a channel 208 which can be seen in FIG. 2.

When the container is to be folded flat for storage or transport, the two flaps 206 and 207 are moved upwardly into the container, as indicated by the arrows 209 and 210 (FIG. 2), until the flap 206 rests against the rear wall 205, and the flap 207 rests against the front wall 202. It will be seen from FIG. 2 that the area of each flap is approximately the same as the area of the front wall 202.

Once the flaps 206 and 207 have been moved into the positions shown in FIG. 2, the container can be collapsed as shown in FIG. 3. For this purpose the front wall 202 is moved to the right, as seen in the drawings, with respect to the rear wall 205 so that the front edges of the two side walls 203 and 204 also move to the right. This movement causes the front wall 202 and the side wall 203 to move towards the rear wall 205. Similarly the wall 204 moves until it is coplanar with the rear wall 205 and forms an extension of the righthand edge of the rear wall.

The container illustrated in FIGS. 1-3 consists of six pieces of board sandwiched between sheets of weldable synthetic resin material. The two sheets of synthetic resin material are welded together around the edges of each piece of board so that it is completely enclosed in the material. The synthetic resin material is also used to form the hinge connections between the adjacent walls, and also to form the channel 208.

The container illustrated in FIGS. 1-3 may be manufactured by placing four pieces of board, shaped to correspond to the side wall 203, the rear wall 205, the side wall 204 and the front wall 202, side by side on to a flat sheet of flexible weldable material. The boards are covered with a second sheet of similar material and the two sheets are then welded together around the edges of the boards. Three of these welds will form hinge lines respectively between the walls 203 and 205, 205 and 204, and 204 and 202. At the same time as forming these hinge connections, the welding process will also be used to form a strip of double flexible material along the front edge of the side wall 203, and a similar strip of double flexible material along the lefthand edge of the front wall 202.

The two flaps 206 and 207 are manufactured in a similar way by placing two pieces of board side by side on a sheet of flexible weldable material and covering them with a further sheet of similar material. The two sheets of material are then welded together to enclose the two boards. The two pieces of board are spaced apart sufficiently for a strip of double flexible material to be formed between them. This strip is cut down the middle so that each flap has a strip of flexible material projecting from one of its longer edges. These two strips are then used to form the hinge connections between the flaps of the front and rear walls by further welding. It is, of course, to be understood that the hinge of the flap 206 will be attached to the rear wall along a line which is displaced vertically upwards from the bottom edge of the rear wall by the thickness of the flap 207. The welding process will also be used at this stage to form the channel 208.

Finally, the two side walls 203 and 204 are folded so that they project perpendicularly from the rear wall 205, and the front wall 202 is folded so that it is parallel with the rear wall. The strip of double flexible material along the lefthand edge of the front wall 202 is then welded to the strip of double flexible material along the front edge of the side wall 203 to form a hinge connection therebetween.

Preferably an adhesive is incorporated between each of the sheets of flexible material and the boards. This ensures that the flexible material remains in contact throughout its area with the boards, and this improves the appearance of the container.

Figure 4:
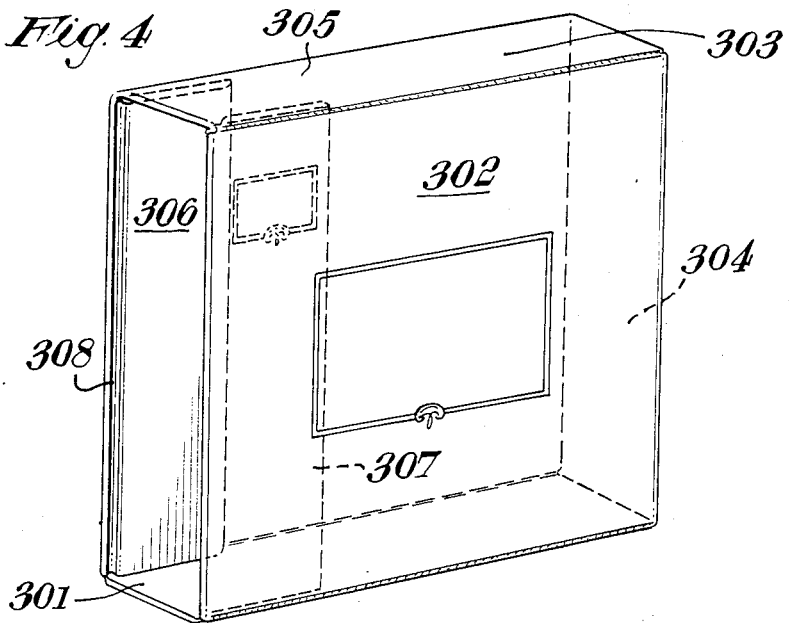
FIG. 4 is a perspective view of a second embodiment of a container in accordance with the invention, showing the two flaps folded inwardly ready for the container to be folded flat.
Figure 5:
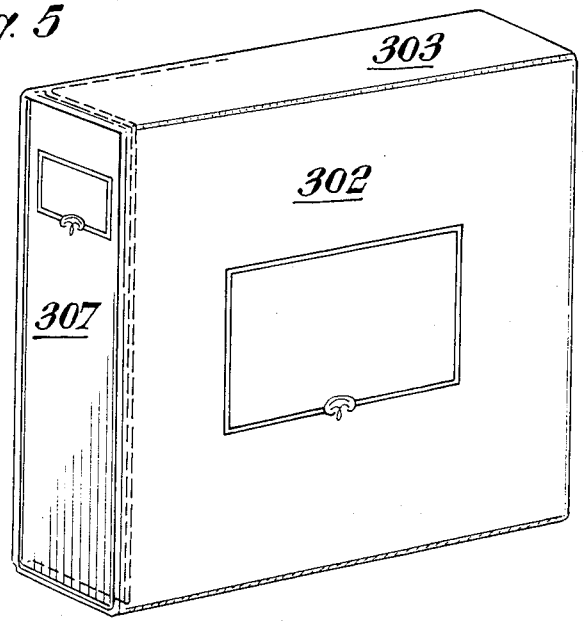
FIG. 5 shows the container of FIG. 4 in the normal condition of use.

Referring now to FIGS. 4 and 5 of the drawings, it will be seen that the container illustrated includes a base 301, a front wall 302, a top wall 303, and a rear wall 305. In addition the container includes a side wall which is formed by two flaps 306 and 307. The flap 306 is hingedly connected to the rear wall 305, and the flap 307 is hingedly connected to the front wall 302. The other side of the container 304 is open. When the container is in the normal condition of use, as illustrated in FIG. 5, the two flaps 306 and 307 are in contact with one another, with the flap 307 on the outside and with the flap 306 inside the container. In this condition the lefthand edge of the flap 307 engages in a channel 308 in the rear wall 305.

When the container is to be folded flat for storage or transport, the two flaps 306 and 307 are folded into the position shown in FIG. 4, so that the flap 307 is in contact with the front wall 302 and the flap 306 is in contact with the rear wall 305.

Once the flaps 306 and 307 have been moved into the positions shown in FIG. 4, the container can be collapsed by lowering the rear wall relative to the front wall, so that the base 301 is rotated about its hinge connection with the front wall 302 until it is coplanar therewith. This movement will also rotate the top 303 about its hinge connection with the rear wall 305 until it is coplanar therewith. Under these conditions the front and rear walls will be adjacent to one another, with the two flaps 306 and 307 sandwiched therebetween.

As in the case of the embodiment illustrated in FIGS. 1-3, the various walls of the container consist of boards enclosed in flexible synthetic resin material.

One form of apparatus for manufacturing a container, as illustrated in FIGS. 4 and 5, will now be described with reference to FIGS. 6-22 of the Drawings.

Figure 6:
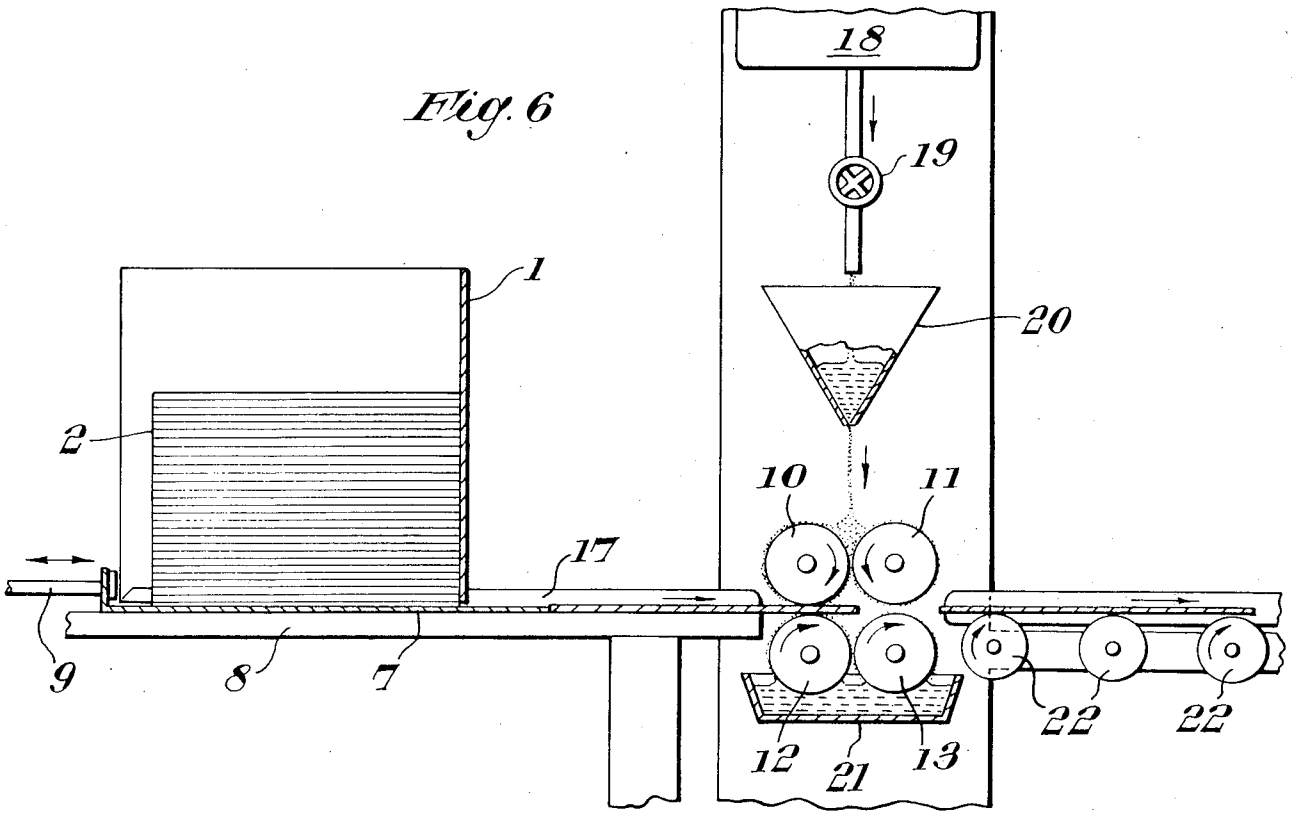
FIG. 6 is a side view of apparatus used in a first stage of the manufacture of a container substantially as illustrated in FIGS. 4 and 5.
Figure 7:
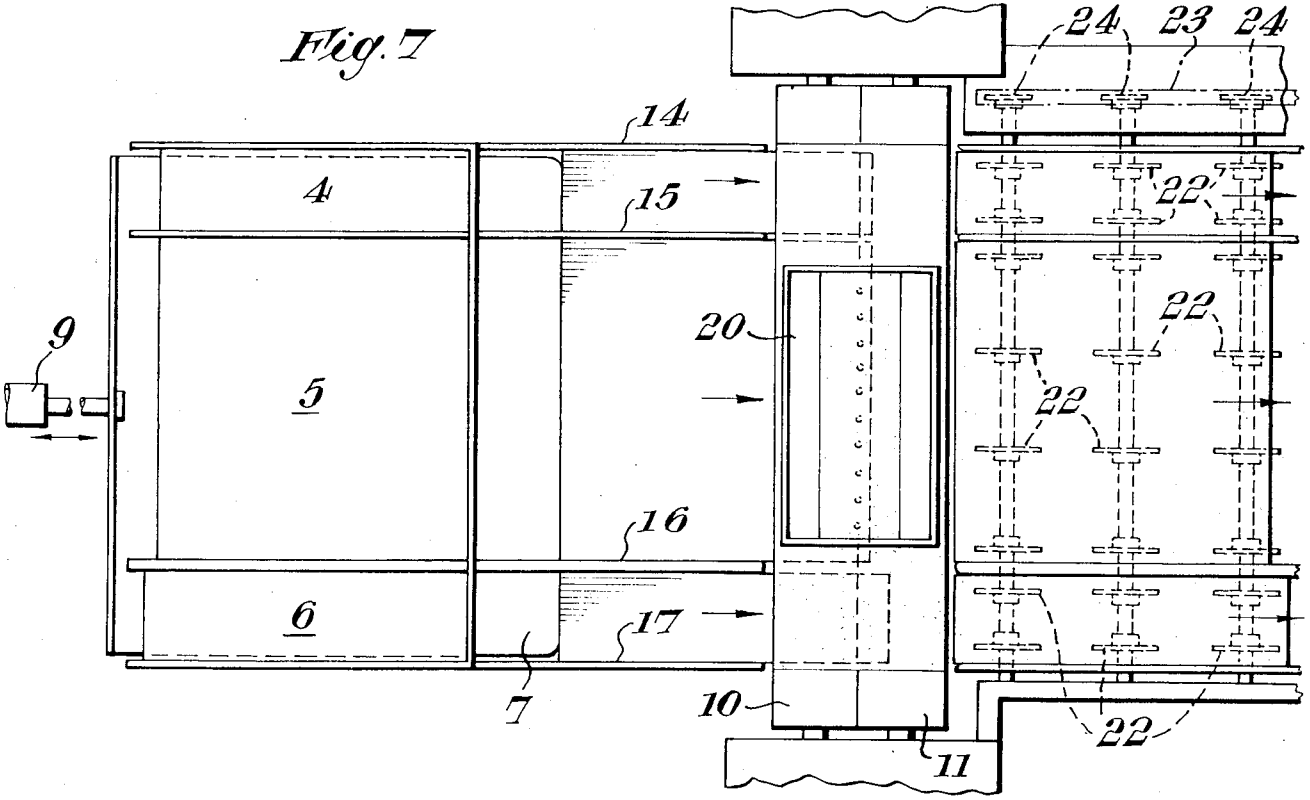
FIG. 7 is a plan view of the apparatus shown in FIG. 6.

Referring now to FIGS. 6 and 7, it will be seen that the apparatus includes a housing 1 containing three stacks 2 of boards 4, 5 and 6. Each container to be manufactured requires two of each of the boards 4, 5 and 6. The two boards 5 are incorporated in what will be termed the front and rear walls of the container, while the two boards 4 are incorporated in what will be termed the two side walls of the container. The two boards 6 are incorporated in the two flaps.

The boards 4, 5 and 6 rest on a plate 7 which is slidable on a table 8. A ram 9 controls the reciprocating action of the plate 7 to move one of each of the boards 4, 5 and 6 at a time to the right, as seen in FIGS. 6 and 7.

The three boards removed from the stacks by the plate 7 are fed between guides 14, 15, 16 and 17 and pass between rotating rollers 10, 11, 12 and 13. An adhesive is applied by the rollers 10 and 11 to the upper surface of each of the boards. The adhesive is contained in a tank 18 and passes through a control valve 19 into a perforated hopper 20, from which it falls on to the upper surfaces of the rollers 10 and 11. Adhesive is also contained in a trough 21 and is picked up from the trough by the rotating rollers 12 and 13. This adhesive is applied by these rollers to the under surface of each of the boards.

The three boards are conveyed further to the right, as seen in FIGS. 6 and 7, by means of rotating discs 22 which are driven by a chain 23 and sprockets 24. These discs serve to transfer the boards to the part of the apparatus illustrated in FIGS. 8 and 9.

Figure 8:
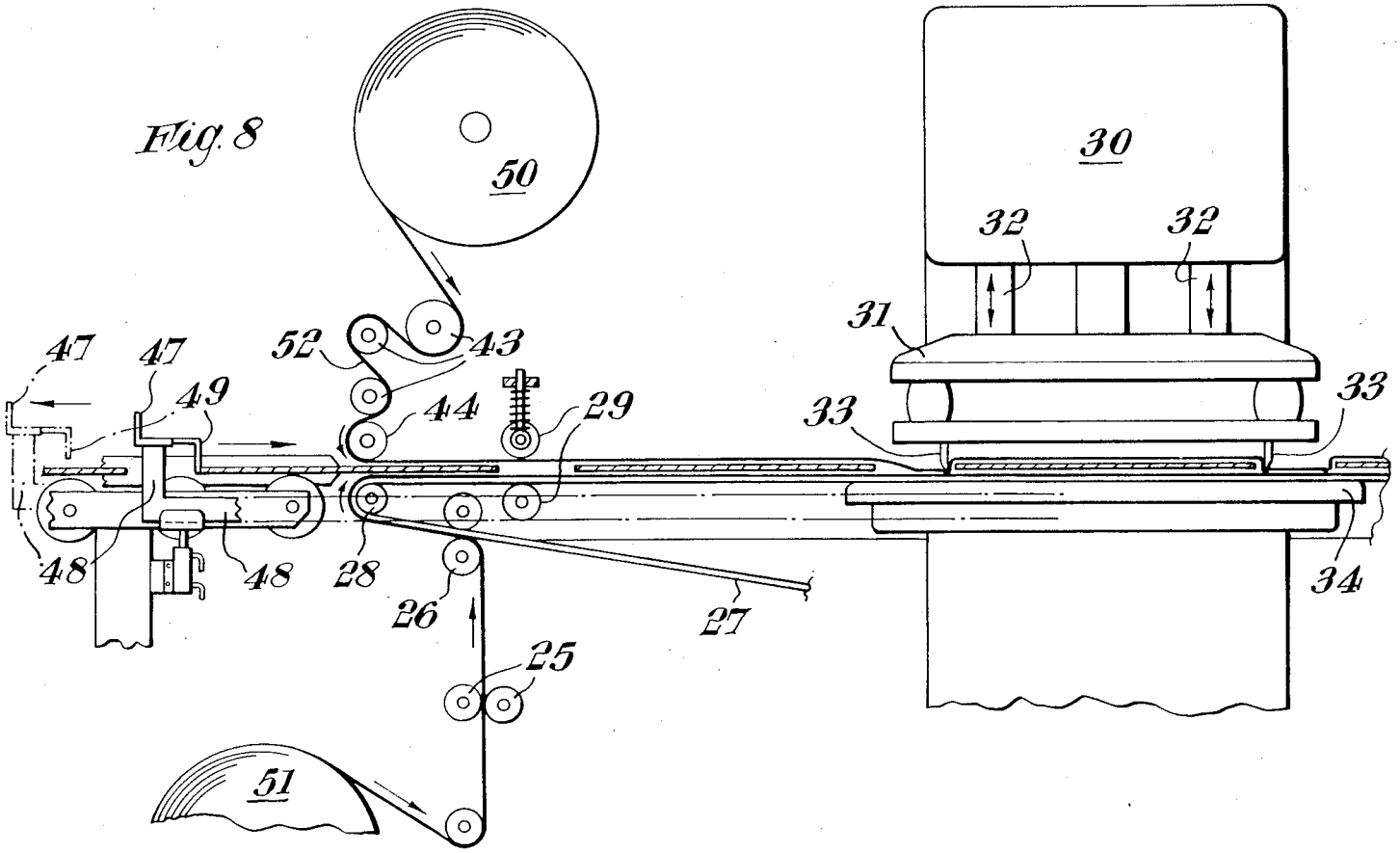
FIG. 8 is a side view of the apparatus used in a second stage of the manufacture.
Figure 9:
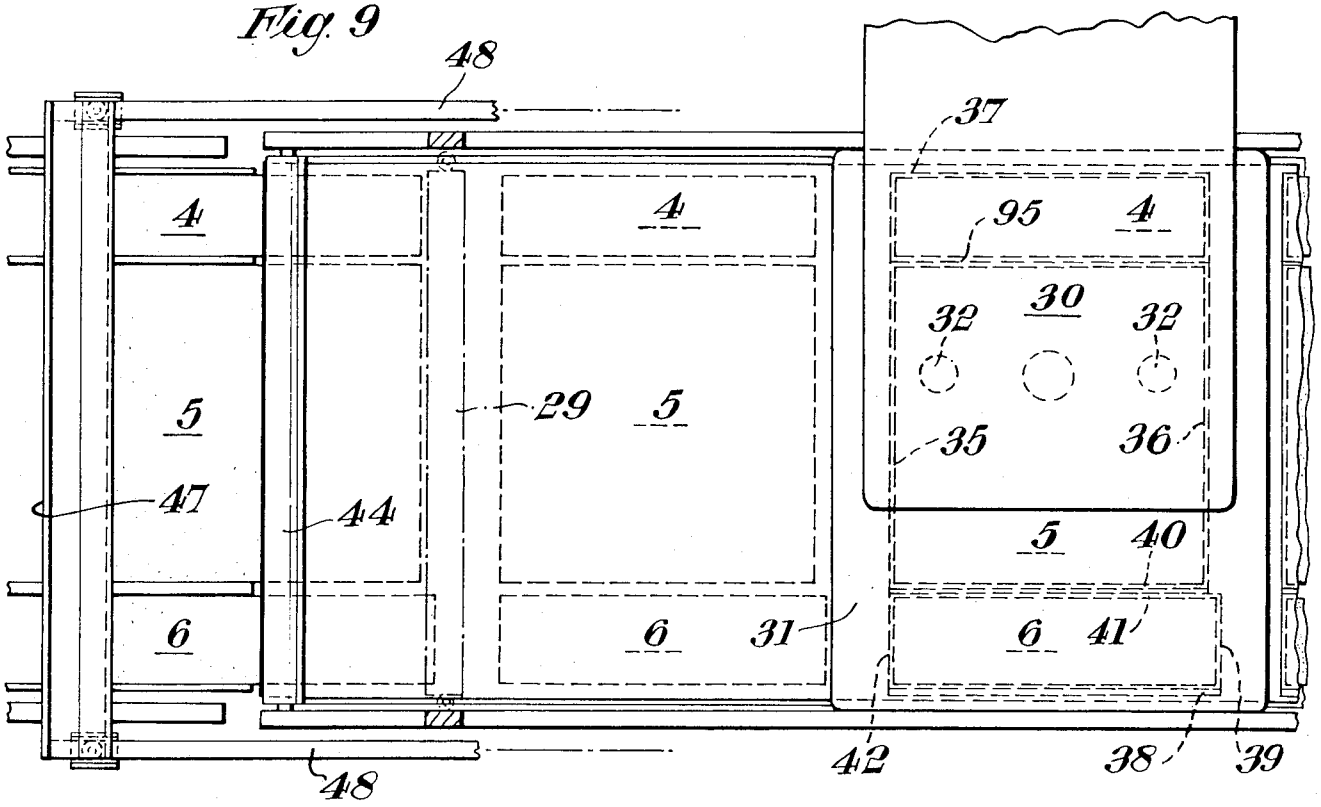
FIG. 9 is a plan view of the apparatus shown in FIG. 8.

When the three boards arrive at the left-hand side of the apparatus illustrated in FIGS. 8 and 9, they pass under a push bar 47 carried on a reciprocating frame 48. As indicated in broken lines in FIG. 8, the bar and frame are raised to allow the boards to pass under the edge 49 of the push bar 47. The push bar feeds the boards into the mouth of converging webs of PVC material drawn from supply rolls 50 and 51. An upper web 52 of this material is drawn off the roll 50 by rollers 43 and applied to the upper surfaces of the boards by a roller 44. The material from the roll 51 is drawn off by rollers 25 and passes round a roller 26 together with an endless belt 27. Finally the material from the roll 51 passes over a roller 28 together with the web 27 and is urged against the underneath surfaces of the boards. The boards now sandwiched between the PVC webs and resting on the endless belt 27 pass through pressure rollers 29 which serve to cause the PVC webs to adhere to the respective surfaces of the boards.

The PVC webs and the boards now pass into a first welding station 30. This station includes a press 31 controlled by hydraulic rams 32. Attached to the press 31 are welding electrodes 33 which cooperate with a flat table 34 to weld the two PVC webs together around the peripheries of the boards 4, 5 and 6. The welding electrodes are arranged so that they not only weld the two webs together along the lines 35 to 42 and 95, but also almost cut through the webs along the lines 35, 36, 37, 38, 39, 40 and 42. The welding electrodes are also arranged so that the cuts along the lines 35, 38, 39 and 42 are close to the edges of the respective boards, whereas the cuts along the lines 36 and 37 are spaced a short distance from the respective edges of the boards 4 and 5. In addition the cut along the line 40 is spaced a short distance from the edge of the board 5 and is spaced a greater distance from the adjacent edge of the board 6. Furthermore, the welding electrode, which welds the two webs together along the line 95 between the boards 4 and 5, is arranged to produce a hinge connection between these two boards. If desired, the welding edge of this electrode may be serrated, whereas the other welding electrodes have smooth edges.

It is to be understood that the spacing of the cuts along the lines 36 and 37 from the respective edges of the boards 4 and 5 will produce narrow strips of double thickness PVC projecting from the respective edges of the boards. Similarly the spacing of the line 40 from the edge of the board 5 will produce a narrow PVC strip along this edge and the spacing of the line 40 from the edge of the board 6 will produce a wider strip attached to the board 6 extending between the two lines 40 and 41. As will be explained later, these strips are used to join together the various parts which constitute the container.

It has already been stated that the boards are fed between the rollers 44 and 28 by a push bar 47 carried on a reciprocating frame 48. The reciprocating motion of the frame 48 is produced by means of an oscillating crank 60 (FIGS. 10 and 11) driven by an electric motor 61. The free end of the crank 60 is provided with a roller 62 which runs in a transverse channel 63 formed by angle members attached to the frame 48. The frame 48 is carried in a plurality of bearings 64, only one pair of which is shown in the drawings.

Figure 10:
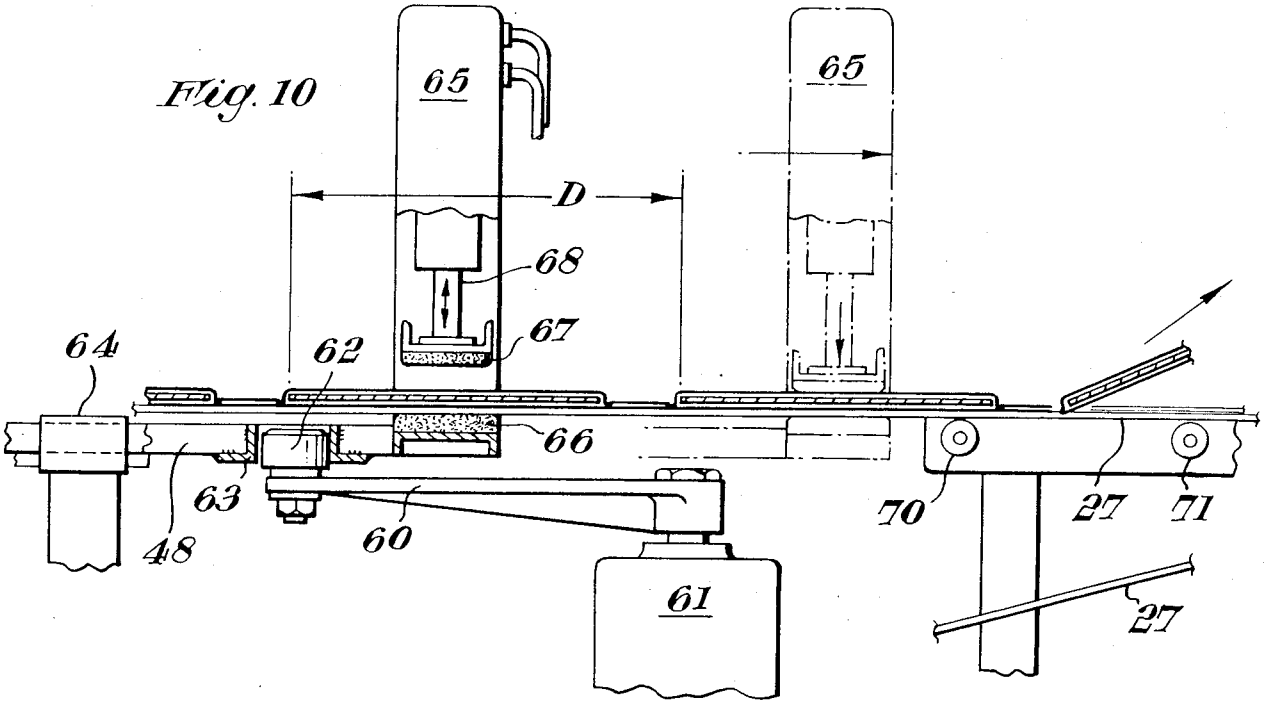
FIG. 10 is a side view of the apparatus used in a third stage of the manufacture.
Figure 11:
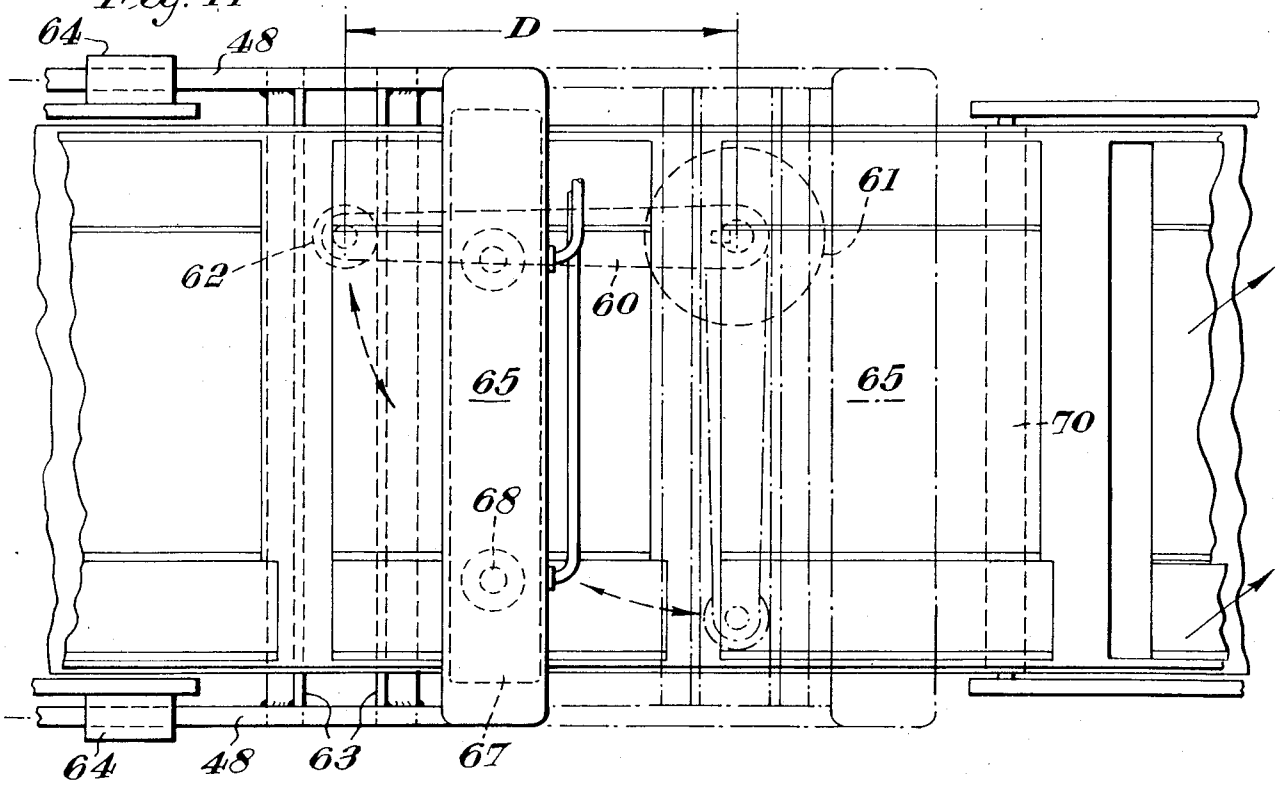
FIG. 11 is a plan view of the apparatus shown in FIG. 10.

Also mounted on the frame 48 is a gripping device 65. This device includes a lower fixed pad 66 and an upper pad 67. The pad 67 is carried on a hydraulic ram 68. The reciprocating motion of the frame causes the gripping device 65 to move between the lefthand position, shown in FIG. 10 in full lines, and the righthand position, shown in broken lines. It is to be understood that, while the gripping device is moving to the right, as seen in FIG. 10, the ram 68 is extended so that the PVC webs, the boards and the endless belt are gripped between the upper and lower pads 67 and 66. On the other hand, when the gripping device 65 is moving to the left as seen in FIG. 10, the hydraulic ram 68 is retracted so that the pads 66 and 67 are separated. It will be understood that the movement of the gripping device pulls the PVC material intermittently off the rolls 50 and 51, and it also serves to drive the endless belt 27. It is to be noted that the crank 60 is oscillated through 90 degrees, which moves it from a position in which it is parallel to the longitudinal direction of the frame 48 into a position in which it is parallel with the channel 63 in order to move the gripping device 65 to the right. Return motion of the gripping device to the left is produced by anticlockwise movement of the crank 60 (as seen in FIG. 11) from the position in which it is parallel to the channel 63 to the position in which it is parallel to the longitudinal direction of the frame. The distance through which the gripping device 65 is moved is equal to the distance D between the rear edges of successive sets of boards travelling on the belt 27.

When the PVC-covered boards are released by the gripping device 65 at the end of its travel to the right, the belt 27 is supported by rollers 70 and 71. At this stage the successive sets of boards are lifted manually and separated from the PVC webs along the line 35. Thereafter the board 6 is separated from the board 5 along the line 40, thus leaving a relatively large strip of double PVC material extending along one of the longer edges of the board 6. Similarly the boards 4 and 5 will be hingedly connected together by a double PVC strip, and in addition smaller strips of PVC material will remain along two adjacent edges of the board 5 and along the edge of the board 4 remote from the hinge connection.

Figure 12:
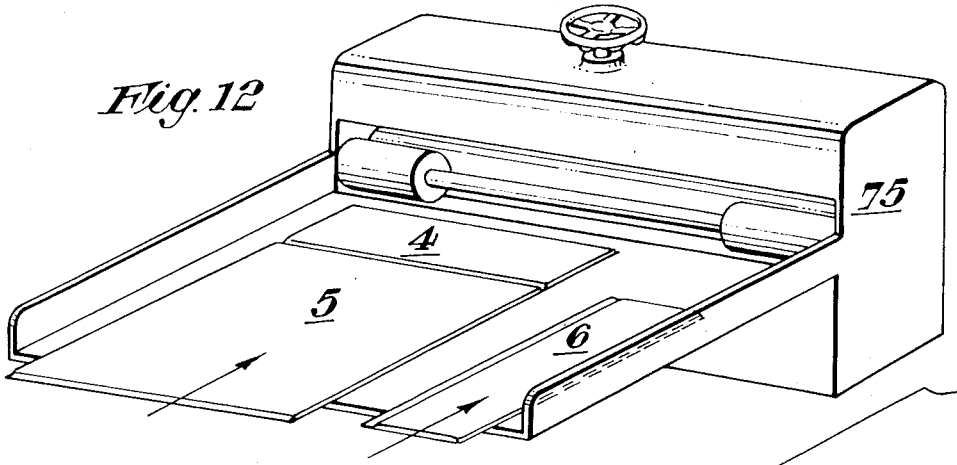
FIG. 12 is a perspective view of a manually operated pressure roll unit used in a further stage of the manufacture.
Figure 13:
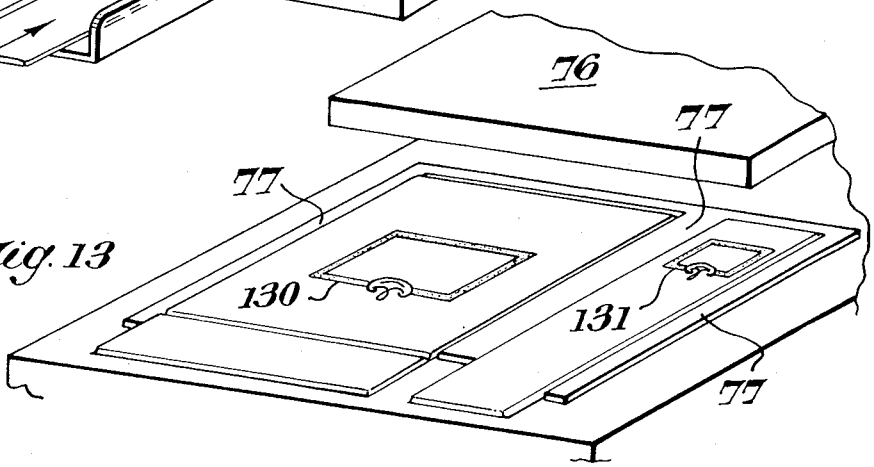
FIG. 13 is a perspective view of part of a printing of embossing press.

The PVC-covered boards are now fed through a small hand-operated pressure roll unit 75 illustrated in FIG. 12. This unit eliminates any air bubbles trapped between the PVC and the boards, and ensures adhesion of the PVC to the boards. Printing and/or embossing is next carried out in a press 76 which is diagrammatically illustrated in FIG. 13, the covered boards being held in the correct relative positions by means of a jig 77. Printing on what will be the exterior surface of one of the panels is diagrammatically illustrated at 130 and printing on what will be the exterior surface of one of the flaps is similarly illustrated at 131.

Figure 14:
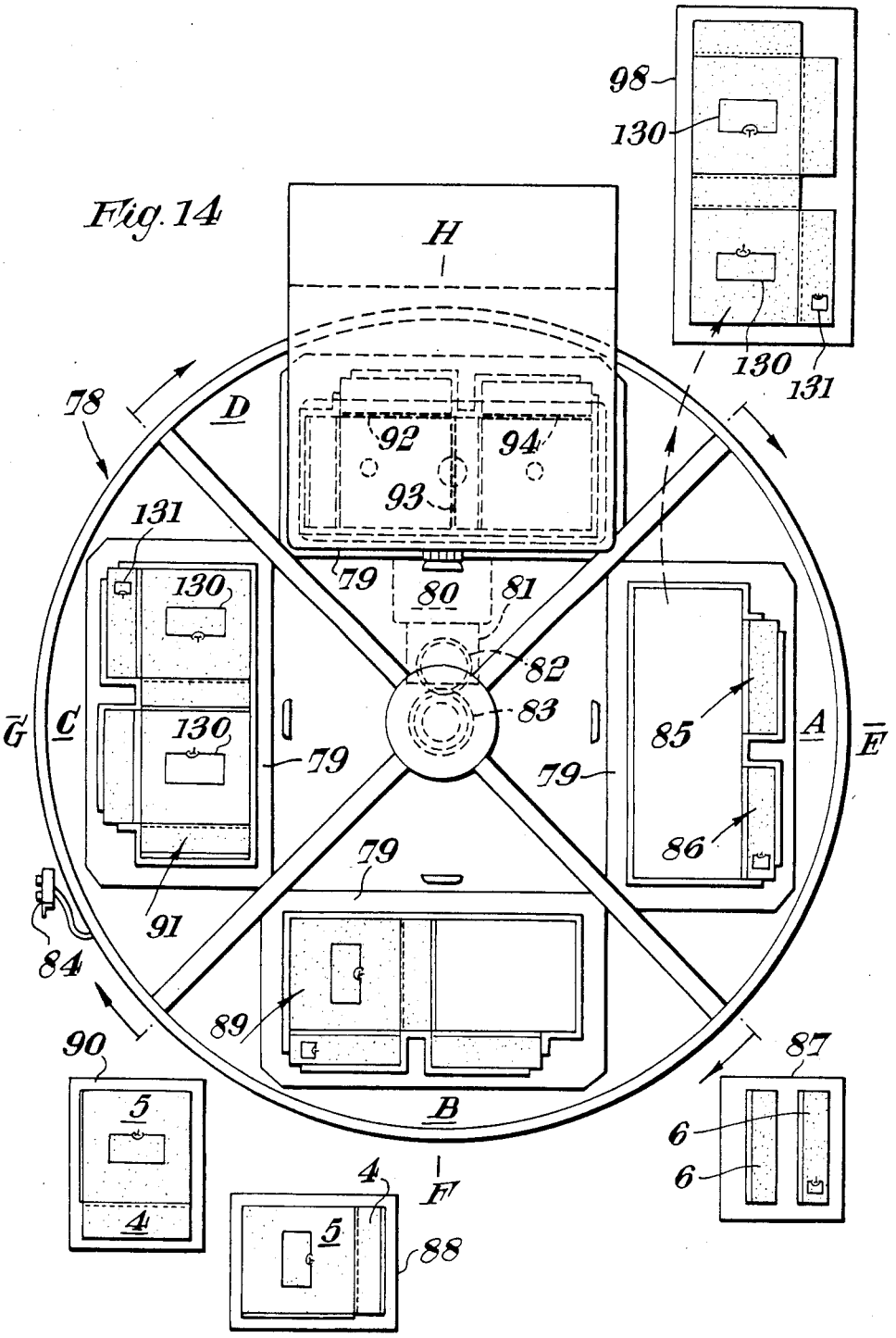
FIG. 14 is a plan view of a turntable used in a further stage of the manufacture.

The printed boards leaving the press 76 may be stacked and stored if required before being transported to a turntable 78 which is illustrated in FIG. 14. The turntable 78 is divided into four stations A, B, C and D, each of which is provided with a jig 79. Operators stand in the positions indicated at E, F, G and H. The turntable is rotated in a clockwise direction, as seen in FIG. 14, in steps of 90 degrees driven by an electric motor 80 through a gear box 81 and gear wheels 82 and 83. The intermittent motion of the turntable is controlled by an operator standing in the position G by means of buttons on a control panel 84. The operator standing at E takes two of the covered boards 6 from the stack indicated at 87 and places them in the jig in the positions indicated by the arrows 85 and 86. The operator standing at F takes a unit comprising two covered boards 4 and 5 from the stack indicated at 88 and places it in the jig in the position indicated by the arrow 89. The operator standing at G takes a similar unit, consisting of covered boards 4 and 5, from the stack indicated at 90 and places it in the jig in the position indicated by the arrow 91. It will be understood that this operation is carried out continuously and that as soon as, for example, the operator at E has placed two boards 6 into the jig, the jig is rotated through 90 degrees so that station A comes opposite to the operator at F. Thus, when the operator at F puts his unit comprising boards 4 and 5 into the jig, the two boards 6 are already in the jig. Similarly, after the next 90 degree rotation of the turntable, the station A will reach the operator G so that, when this operator places his boards 4 and 5 into the jig, the jig will already contain the unit inserted by the operator at F as well as the two boards 6 inserted by the operator at E.

On the fourth rotation of the turntable the station A having the two composite units and the two boards 6 will arrive at the position H. This is a welding position and, when the operator at H actuates the welding press, welds are produced along the lines 92, 93 and 94. After the next rotation of the turntable the station A returns to the position E and the operator at the position removes the complete unit from the jig before inserting the two boards 6 ready for the next series of operations. He places the unit in a stack as indicated at 98.

Figure 15:
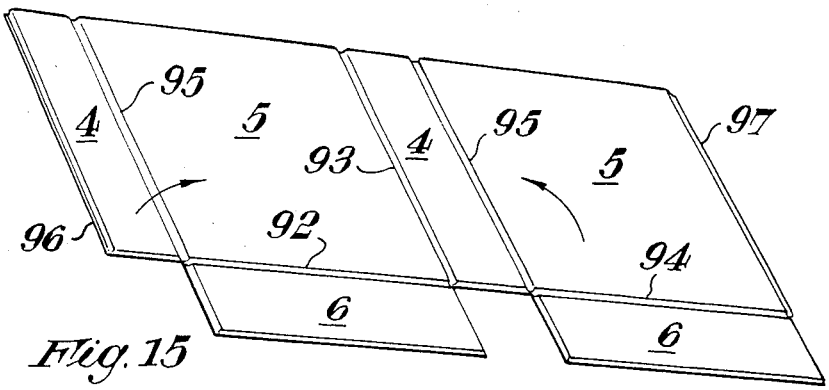
FIG. 15 is a perspective view of the blank produced on the turntable illustrated in FIG. 14.

One of the units in the stack 98 is shown in FIG. 15 and it will be seen that welds have been produced along the lines 92, 93, 94 and 95. It will be recalled that the two welds 95 were produced in the welding station 30, whereas the welds 92, 93 and 94 were produced at the welding position H. The welds 95 merely serve to join together the upper and lower webs of PVC material so as to produce two hinge connections. On the other hand the weld 93 serves to join the PVC strip along the right-hand edge of the lefthand board 5 to the PVC strip along the lefthand edge of the righthand board 4. As was previously described, these strips were produced in the welding station 30. Similarly the weld 92 serves to join the relatively wide PVC strip along one edge of the lefthand board 6 to the PVC strip along the adjacent edge of the lefthand board 5. It will be recalled that the strip along the edge of the board 5 was produced by the weld along the line 36, while the strip along the edge of the board 6 was produced by the welds along the lines 40 and 41 (FIG. 9). Similary the weld 94 serves to join the relatively wide PVC strip along one edge of the righthand board 6 to the PVC strip along the adjacent edge of the righthand board 5. Finally it is to be understood that all the joints produced by the welds 92–95 serve to produce hinge connections between the adjacent boards.

It will be noted that in FIG. 14 the printed patterns 130 and 131 are visible when the blanks are on the turntable 78. This indicates that what will be the exterior surfaces of the panels and flaps are uppermost when the welding operation is carried out at H. On the other hand, the printed patterns are not shown in FIG. 15 and this indicates that the blank is turned over before being placed on the table 100. One pattern 130 and one pattern 131 are again shown in FIG. 17 because the right-hand panel 5 of FIG. 15 together with its attached flap 6 have been turned through 180 degrees between the positions shown in FIGS. 15 and 17.

The next stage of the operation is to weld the strip 96, which was produced by the weld line 37 along the free edge of the lefthand board 4, to the strip 97 which was produced by the weld line 40 along the free edge of the righthand board 5. For this purpose the blank is moved on to a table 100, illustrated in FIGS. 16 and 17. The lefthand board 4, with the strip 96, is raised vertically, as also is the righthand board 5 together with its attached board 6. The blank is positioned on the table 100 between side members 101 and 102 of a jig, which also includes rear portions 103 and 104. It will be seen that the lefthand board 5 and the righthand board 4 are accommodated flat on the table 100 between the jig members 101 and 102.

Figure 16:
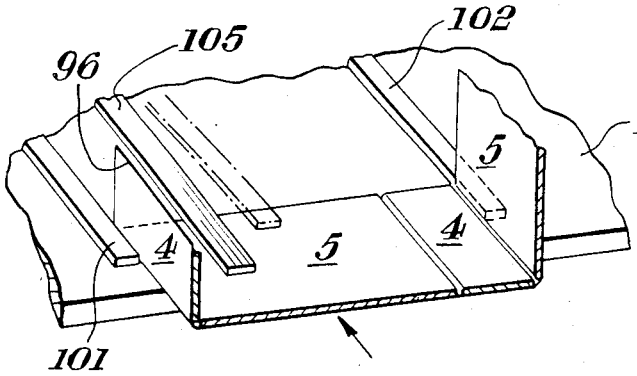
FIG. 16 is a perspective view of a jig in which the blank shown in FIG. 15 is placed.
Figure 17:
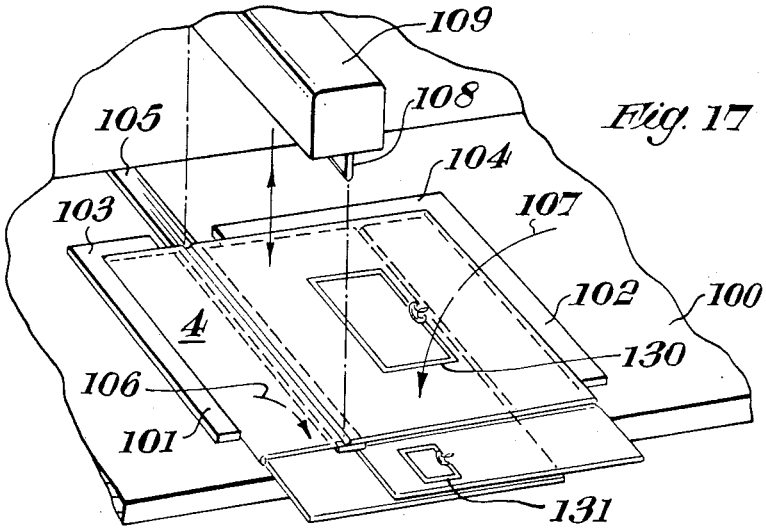
FIG. 17 illustrates a welding operation carried out in the jig shown in FIG. 16.

When the blank is first inserted in the jig, a protective metal strip 105 is raised as shown in FIG. 16. Once the blank is in position this protective strip is lowered on to the surface of the board 5 which is on the table 100. The lefthand board 4 is now folded downwardly as indicated by the arrow 106 in FIG. 17 so that the PVC strip 96 lies on top of the protective metal strip 105. Thereafter, the righthand board 5 is folded in an anticlockwise direction, as indicated by the arrow 107, so that the PVC strip 97 lies above the PVC strip 96. Thereafter, a welding electrode 108, on a press member 109, is lowered so that it is in contact with the strip 97 and urges the strips 97 and 96 against the protective strip 105. The weld is then made joining the strips 96 and 97 to provide a hinge connection between the lefthand board 4 and the righthand board 5.

When the blank is removed from the table 100, the two boards 5 may be urged apart so that the two boards 4 are positioned at rightangles to the boards 5. The blank then assumes the configuration shown in FIG. 18. Before the next operations are carried out, the two boards 6 are folded inwardly, as indicated by the arrows 110 and 111 in FIG. 19.

The container, as shown in FIG. 19, is now moved into a further welding station, as shown in FIG. 20. One of the boards 5 is placed on a table 112 with the upstanding board 4 against a guide 113. The board 6, which is hingedly connected to the board 5, lies on top of the board 5. The container is moved to the right, as indicated in FIG. 20, until the edge of the board 6 is directly below a welding electrode 114. The electrode is then lowered so that it forms a further weld along the margin of the board 5, as indicated at 115.

The production of this weld is indicated on an even larger scale in FIG. 21, which also indicates clearly the small cutaway portion of the electrode 114 at 116. It will be seen that there are five strips of PVC material welded together in this operation. These strips are constituted by edge portions respectively of the two covers 117 and 118 of the board 6, an edge portion of the outer cover 119 of the board 5 and two edge portions 120 and 121 of the inner cover of the board 5. It will be recalled that at the welding station H the strips constituted by the covers 117, 118, 119 and 120 were welded together along one of the lines 92 and 94. This weld is now folded back above the board 5 so that it is rewelded to the inner cover 121 of the board 4 as indicated at 122. As can be seen clearly in FIG. 21 this folding back and welding produces a raised portion at 123, and air pockets will also be formed as shown at 124 and 125.

In a generally similar operation the other board 6 will be folded back on top of the other board 5 and a reweld similar to that indicated in FIG. 21 will be produced. However, in this case the reweld is located further from the edge of the board 5 than in the case of the weld illustrated in FIG. 21. The complete arrangement, including the two rewelds is shown in FIG. 22 in which the reweld of FIG. 21 is illustrated at 122 while the other reweld is indicated at 128.

The completed container may now be erected, as indicated in FIG. 5, by pushing the two flaps 6 outwardly so that they are at rightangles to the front and rear panels 5 of the container. The location of the flaps is illustrated clearly in FIG. 22 which shows the outer flap resting against the raised portion 123 of the opposite panel of the container. The free edge of the other flap 6 rests on the outer flap in the region of the welded area 122. Thus it will be found with this arrangement that considerable weight can be placed on the two flaps without displacing them from the position shown in FIG. 22. The inner flap 6 cannot move outwardly at its lefthand side because of the weld 128 and it cannot move outwardly at its righthand side because it is prevented by the weld of the outer flap 6 at 122.

It will be seen that a method in accordance with the invention enables a container to be produced which can readily be folded flat for storage or transport and can also be easily erected into a strong and rigid structure.

I claim:

1. A collapsible container, comprising four walls, and a base wall extending generally transversely of and between said four walls when the container is erected, wherein each of said walls is hingedly connected by first flexible hinging means to adjacent ones of said four walls, wherein said base wall comprises first and second flaps, wherein said first flap has a first edge hingedly connected by additional flexible hinging means to a first of said four walls and has a second free edge parallel to said first edge, wherein said second flap has a first edge hingedly connected by further flexible hinging means to a second of said four walls in opposed relation to said first wall and said second flap further has a second edge parallel to said first edge of said second flap, wherein each of said four walls and each of said first and second flaps comprises a board covered on both sides thereof with flexible weldable material, wherein each of said flexible hinging means is comprised of said flexible weldable material, said first and second flaps when extending generally transversely of and between said four walls being in an overlying relationship to each other with said first flap being situated relatively further inwardly of said container than said second flap, and channel-like latching means formed in said flexible weldable material which extends along a face of said first wall to which said first flap is hingedly connected, wherein when in said overlying relationship said second edge of said second flap is detachably latched in said channel-like latching means and the second edge of said first flap operatively rests on said second flap at an area which is at least in close proximity to said first edge of said second flap, and wherein when said first and second flaps are moved from said overlying relationship to positions at least respectively approaching parallelism with said first and second walls said container is enabled to be collapsed.

2. A collapsible container according to claim 1 wherein said flexible weldable material comprises a synthetic resin material.

3. A collapsible container according to claim 2 wherein said synthetic resin material comprises polyvinylchloride sheeting.

4. A collapsible container according to claim 1 wherein said four walls comprise a forwardly disposed front wall having a top edge, a rearwardly disposed rear wall having a top edge and being spaced from said front wall when said container is erected, and first and second side walls spaced from each other when said container is erected, wherein each of said first and second side walls are joined to both of said front and rear walls, wherein the height of said top edge of said front wall is less than the height of said top edge of said rear wall, wherein each of said side walls comprises an upper edge, and wherein the upper edges of both of said first and second side walls are inclined as to join the top edge of said rear wall to the top edge of said front wall.

5. A collapsible container according to claim 1 wherein said four walls comprise a forwardly disposed front wall and a rearwardly disposed rear wall spaced from said front wall when said container is erected, wherein one of said first and second walls comprises said rear wall, and wherein the other of said first and second walls comprises said front wall.

6. A collapsible container according to claim 1 wherein said four walls comprise a forwardly disposed front wall and a rearwardly disposed rear wall spaced from said front wall when said container is erected, and wherein said rear wall comprises said first wall.

7. A collapsible container according to claim 4 wherein the configuration and dimension of at least one of said first and second flaps are generally equal to the configuration and dimensions of said front wall.

8. A collapsible container according to claim 4 wherein the configuration and dimensions of said second flap are generally equal to the configuration and dimensions of said front wall.

9. A collapsible container according to claim 1 wherein said first flexible hinging means has an effective length between adjacent ones of said four walls which is sufficient to enable the thickness of one of said flaps to be accommodated by said first flexible hinging means when said container is placed into a collapsed condition with said four walls being folded generally flat.

10. A collapsible container according to claim 1 wherein said additional flexible hinging means is displaced further inwardly of said container than is said further flexible hinging means a distance generally equal to the thickness of said second flap.

11. A collpasible container according to claim 1 wherein the side of said container opposite to said base wall is open.

12. A collapsible container according to claim 1 wherein said four walls comprise a forwardly disposed front wall, a rearwardly disposed rear wall spaced from said front wall when said container is erected, first and second side walls spaced from each other when said container is erected, wherein each of said first and second side walls are joined to both of said front and rear walls, and wherein each of said front and rear walls is rectangular.

13. A collapsible container according to claim 12 wherein each of said side walls is rectangular.

14. A collapsible container according to claim 12 wherein each of said side walls is trapezoidal.

15. A collapsible container according to claim 1 wherein said four walls comprise a forwardly disposed front wall, a rearwardly disposed rear wall spaced from said front wall when said container is erected, first and second side walls spaced from each other when said container is erected, wherein each of said first and second side walls are joined to both of said front and rear walls, wherein the length dimension of each of said first and second flaps is generally equal to the spacing between said first and second side walls when said container is erected, and wherein the width dimension of each of said first and second flaps is generally equal to the spacing between said front and rear walls when said container is erected.

16. A collapsible container according to claim 1 wherein when said first and second flaps are in said overlying relationship and said container is erected each of said first and second flaps is generally perpendicular to each of said four walls.

17. A collapsible container according to claim 1 wherein said flexible weldable material comprises plastics sheeting, and wherein each of said four walls and said first and second flaps comprises a board to which said plastics sheeting is bonded by an adhesive.

18. A collapsible container according to claim 1 wherein said four walls comprise a forwardly disposed front wall, a rearwardly disposed rear wall spaced from said front wall when said container is erected, and first and second side walls spaced from each other when said container is erected, wherein each of said first and second side walls are joined to both of said front and rear walls, and wherein said first and second flaps are substantially perpendicular to said first and second side walls when said first and second flaps are in said overlying relationship and the free edge of said second flap is detachably latched in said channel-like latching means.

19. A method of manufacturing a collapsible container comprising the steps of:

(a) covering six boards with flexible weldable material to form respectively front and rear panels, first and second side panels and first and second flaps, said first side panel having a first hinge connection formed by said flexible weldable material with said front panel and said second side panel having a second hinge connection formed by said flexible weldable material with said rear panel;

(b) forming a third hinge connection from said flexible weldable material between the free edge of said first side panel parallel to said first hinge connection and the free edge of the rear panel parallel to the second hinge connection, forming a fourth hinge connection from said flexible weldable material between said first flap and said front panel and a fifth hinge connection from said flexible weldable material between said second flap and said rear panel so that said flaps are substantially in line and perpendicular to said side panels;

(c) forming a sixth hinge connection from said flexible weldable material between the free edge of said second side panel and the parallel free edge of said front panel; the arrangement being such that said flaps can be folded into positions in which they are perpendicular to the front and rear panels and thus hold the side panels in spaced relationship perpendicular to the front and rear panels to define an interior volume of the container; and (d) welding part of the flexible weldable material constituting the fourth hinge connection to a face of the front panel adjacent said interior volume, and welding part of the flexible weldable material constituting the fifth hinge connection to a face of the rear panel adjacent said interior volume, the weld of the material constituting the fourth hinge connection being relatively close to the outer edge of the front panel, while the weld between the material of the fifth hinge connection to the rear panel is displaced inwardly from the outer edge of the rear panel by a distance equal to the thickness of the first flap, and the welding of the material constituting the fifth hinge connection to the rear panel also producing a channel between the outer edge of the rear panel and the weld to receive the free edge of the first flap and hold that flap in position.

20. A method of manufacturing a collapsible container according to claim 19, and further comprising the step of making the front and rear panels of the container to be rectangular.

21. A method of manufacturing a collapsible container according to claim 20, and further comprising the step of making the side panels of the container to be rectangular.

22. A method of manufacturing a collapsible container according to claim 20, and further comprising the step of making the side panels of the container to be trapezoidal.

23. A method of manufacturing a collapsible container according to claim 19, and further comprising the step of making the length dimension of each of the two flaps substantially equal to the spacing between the two side panels when the container is erected, and the step of making the width dimension of each of the flap substantially equal to the spacing between the front and rear panels when the container is erected.

* * * * *